US006986643B2

(12) United States Patent
Huang et al.

(10) Patent No.: US 6,986,643 B2
(45) Date of Patent: Jan. 17, 2006

(54) BLOWER AND THE BLADE STRUCTURE THEREOF

(75) Inventors: Wen-shi Huang, Taoyuan (TW); Kuo-cheng Lin, Taoyuan (TW); Shun-chen Chang, Taoyuan (TW)

(73) Assignee: Delta Electronics, Inc., (TW)

( * ) Notice: Subject to any disclaimer, the term of this patent is extended or adjusted under 35 U.S.C. 154(b) by 126 days.

(21) Appl. No.: 10/278,590

(22) Filed: Oct. 22, 2002

(65) Prior Publication Data

US 2003/0143070 A1 Jul. 31, 2003

(30) Foreign Application Priority Data

Jan. 31, 2002 (TW) ..... 91201079 U

(51) Int. Cl.
*F04D 29/38* (2006.01)

(52) U.S. Cl. ..... 416/183; 416/228; 416/237; 415/206

(58) Field of Classification Search ..... 416/183, 416/187, 228, 237; 415/206
See application file for complete search history.

(56) References Cited

U.S. PATENT DOCUMENTS 2,354,653 A * 8/1944 Allen ..... 416/188
3,075,743 A * 1/1963 Sheets ..... 416/228
3,260,443 A * 7/1966 Garnett et al. ..... 416/183
3,294,365 A * 12/1966 Wilde et al. ..... 416/90 R
6,210,109 B1 * 4/2001 Will et al. ..... 416/183

FOREIGN PATENT DOCUMENTS

JP 55125396 A * 9/1980

* cited by examiner

*Primary Examiner*—Theresa Trieu
(74) *Attorney, Agent, or Firm*—Martine Penilla & Gencarella, LLP

(57) ABSTRACT

The present invention provides a blade structure used in a blower to not only increase the wind pressure and gas quantity but also reduce the noise. The blade structure includes a vane group constituted by a plurality of vanes. A plurality of inclined portions is also included in the blade structure. Each of the plurality of the inclined portions is connected to each of the plurality of vanes of the vane group.

30 Claims, 7 Drawing Sheets

BLOWER AND THE BLADE STRUCTURE THEREOF

BACKGROUND OF THE INVENTION

1. Field of the Invention

The present invention relates to a blade structure and, more particularly, to a blade structure used in a blower.

2. Description of the Related Art

Conventional blowers can be categorized into a single side entry blower and a double side entry blower. As for the single side entry blower, the blade structure used in the blower is a blade structure having equally spaced vanes on a single side. That is, as shown in FIGS. 1A and 1B, all blades 11 of the blade structure are provided on one side of a supporting plate 12. A motor drives the supporting plate to rotate the blade structure. However, such kind of blade structure has the following drawbacks. First, if trying to improve the characteristic of wind pressure, it is necessary to increase the number of the blades of the blade structure so as to increase the wind pressure. However, since the space and size of the blades are limited, the increased number of the blades is inevitably limited. Therefore, it is impossible to make any breakthrough regarding the characteristic of the wind pressure. Second, when the blade structure is rotating, the air stream passes through both the air inlet and the smallest clearance between the vanes and the outer casing 13. Since the air passage is reduced drastically from a large size to a small size, the turbulence and noise may be generated easily.

In addition, referring to FIGS. 2A and 2B, the blade structure of another conventional blower includes a plurality of blades 21. The blades 21 are formed at two sides of a supporting annular plate 22 in an opposite manner to reduce the noise. The number of the blades can be doubled with respect to the above-mentioned blade structure so as to improve the wind pressure characteristic without changing the size of the blower. However, since the added annular plate may decrease the working area and block the passage of the air stream, a predetermined wind pressure and gas quantity may be lost.

In view of the above-mentioned drawbacks in the prior art, the present invention provides an improved blower and the blade structure thereof.

SUMMARY OF THE INVENTION

It is therefore an object of the present invention to provide a blade structure for a blower to not only increase the wind pressure and gas quantity but also reduce the noise.

According to one aspect of the present invention, the blade structure includes a vane group and a plurality of inclined portions. The vane group is constituted by a plurality of vanes. Each of the plurality of inclined portions is connected to each of the plurality of vanes of the vane group.

In addition, the blade structure may further include a base around which the plurality of vanes of the vane group is mounted. The base, the vane group, and the plurality of inclined portions may be integrally formed. The base may be formed with a central opening for a motor driving the blade structure to be mounted therein. Preferably, the plurality of vanes of the vane group may partially protrude from a bottom of the base.

Furthermore, the blade structure may further include a hoop mounted around a top edge of each of the inclined portions.

According to another aspect of the present invention, the vane group and the plurality of inclined portions may be alternately arranged in multiple levels to increase the wind pressure of the guided air stream. Each of the plurality of vanes of the vane group may have a structural type selected from the group consisting of a curved surface, an inclined surface, an arched surface, and a flat surface.

According to still another aspect of the present invention, the blade structure includes a first vane group constituted by a plurality of vanes, a second vane group constituted by a plurality of vanes, and a plurality of inclined portions connected between the vanes of the first and second vane groups. The vanes of the first and second vane groups may be arranged alternately.

BRIEF DESCRIPTION OF THE DRAWINGS

The above-mentioned and other objects, features, and advantages of the present invention will become apparent with reference to the following descriptions and accompanying drawings, wherein.

DETAILED DESCRIPTION OF THE PREFERRED EMBODIMENTS

Figure 1A:
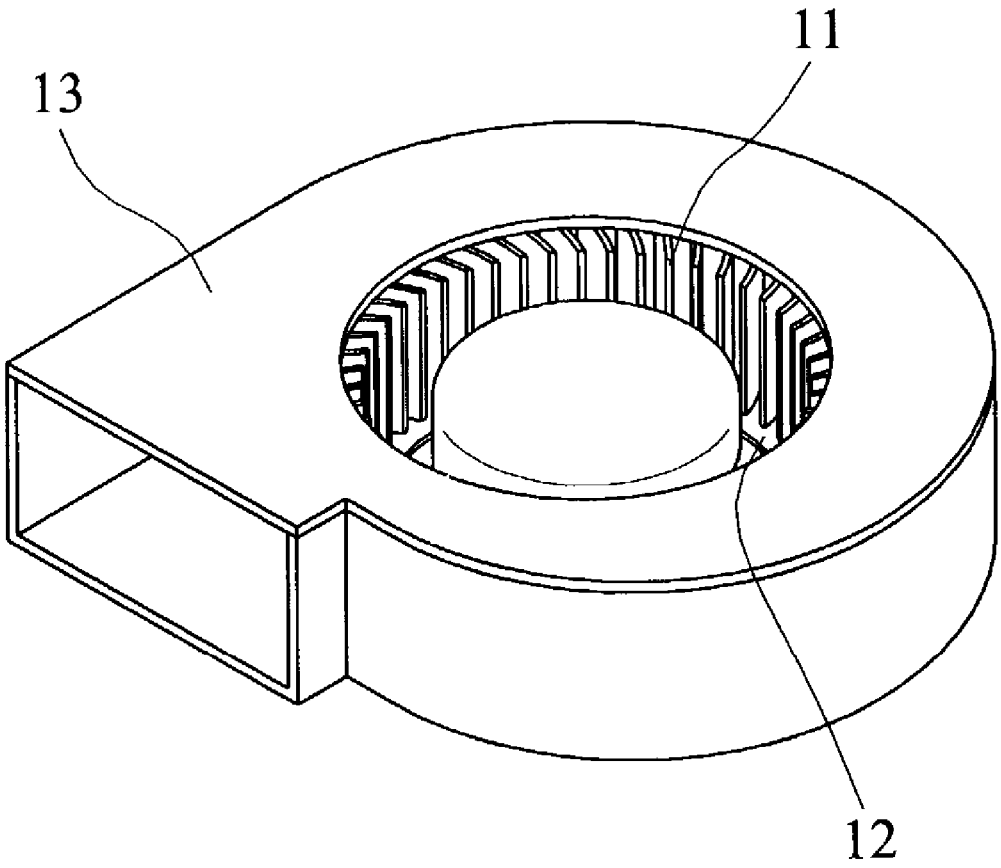
FIG. 1A (PRIOR ART)
FIG. 1A is a pictorial view showing a first type of a conventional blower.
Figure 1B:
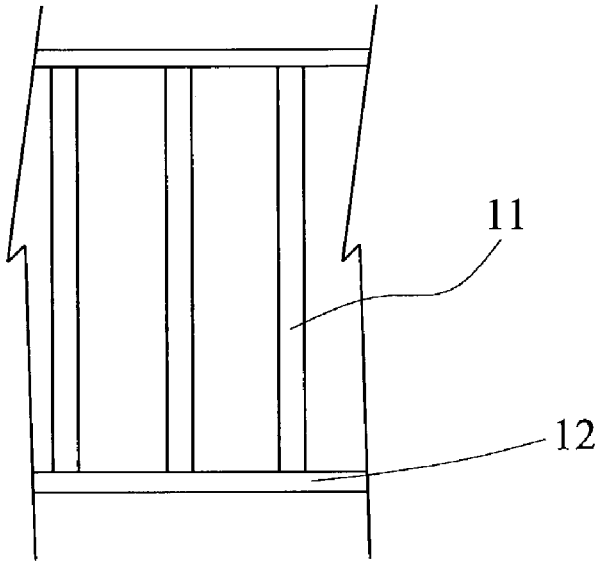
FIG. 1B (PRIOR ART)
FIG. 1B is a partially cross-sectional view showing the blade structure of the blower as shown in FIG. 1A.
Figure 2B:
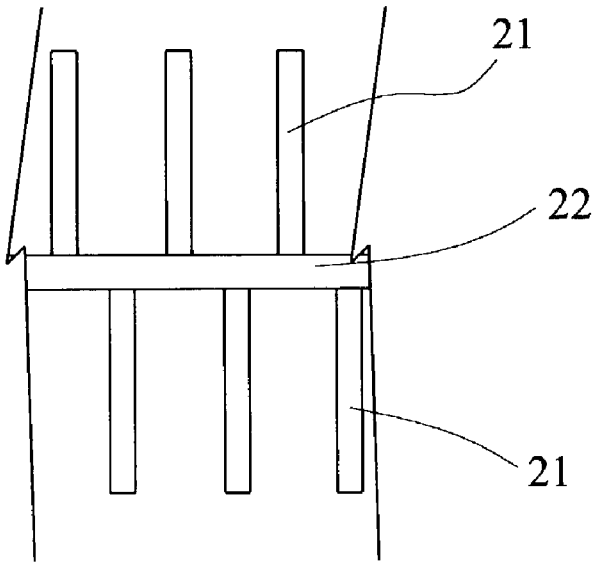
FIG. 2B (PRIOR ART)
FIG. 2B is a partially cross-sectional view showing the blade structure of the blower as shown in FIG. 2A.
Figure 2A:
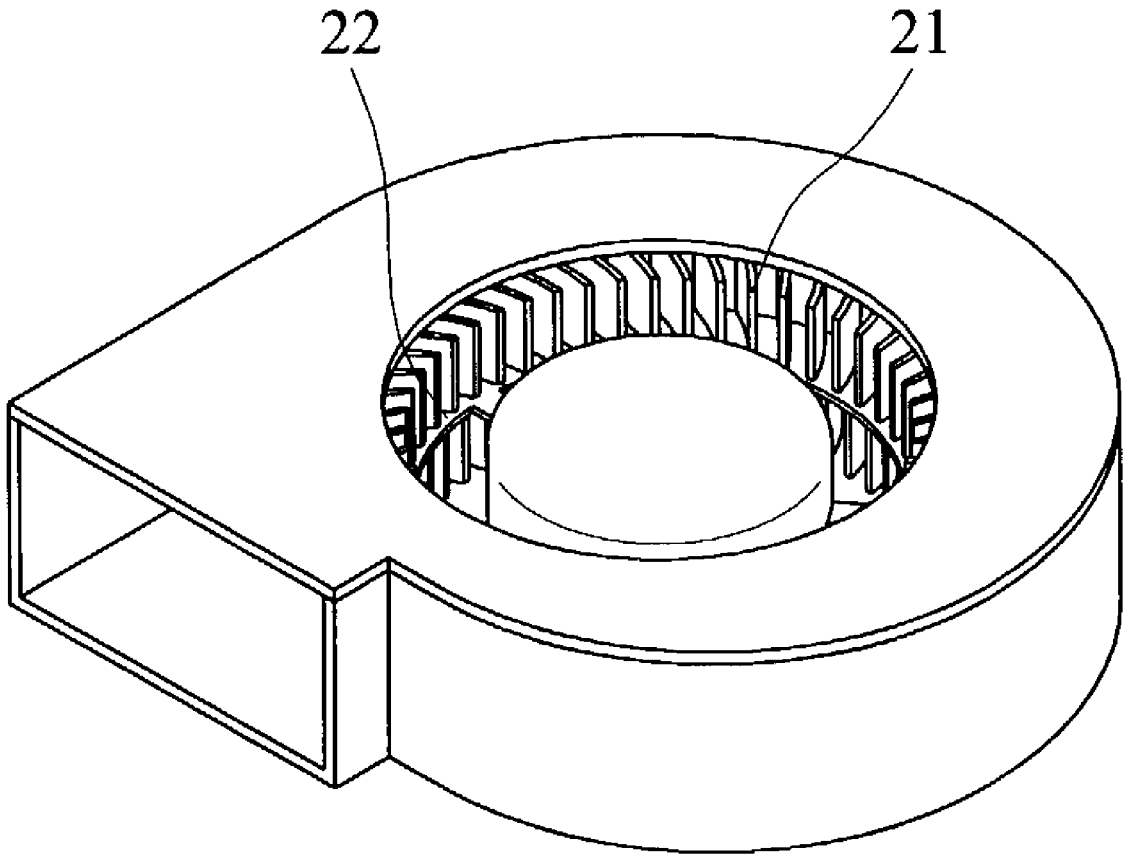
FIG. 2A (PRIOR ART)
FIG. 2A is a pictorial view showing a second type of the conventional blower.
Figure 3:
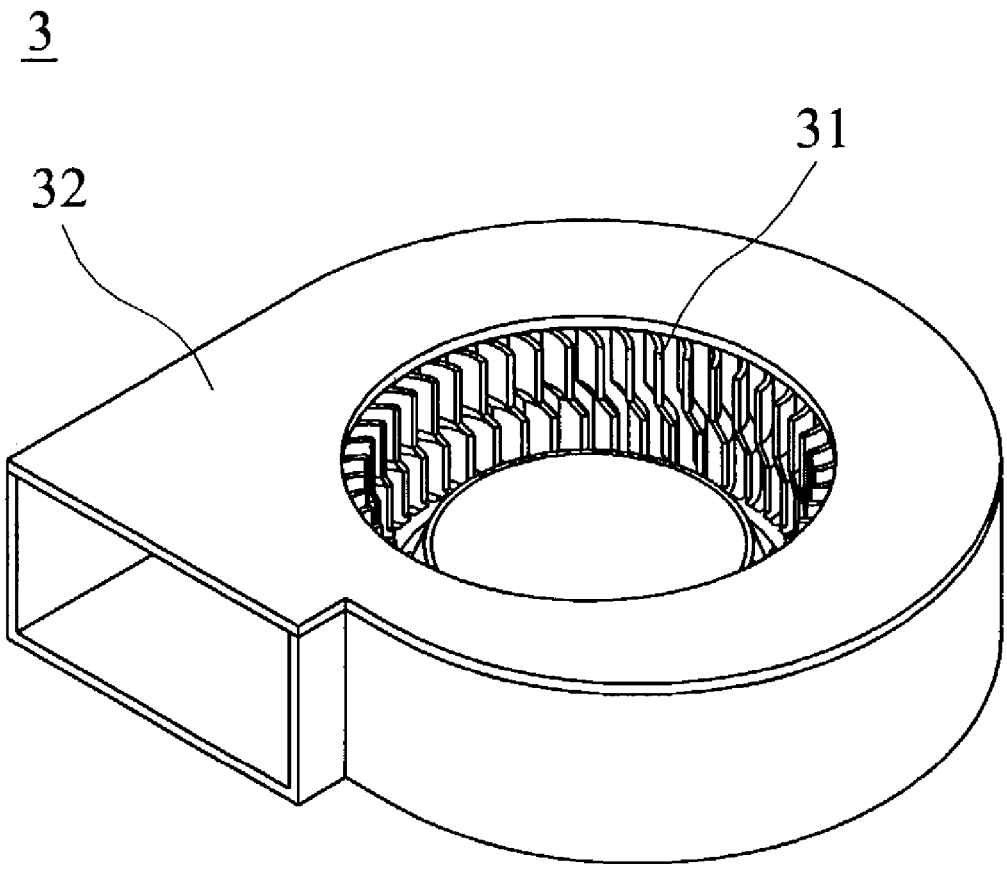
FIG. 3 is a pictorial view showing a blower of the present invention.
Figure 4A:
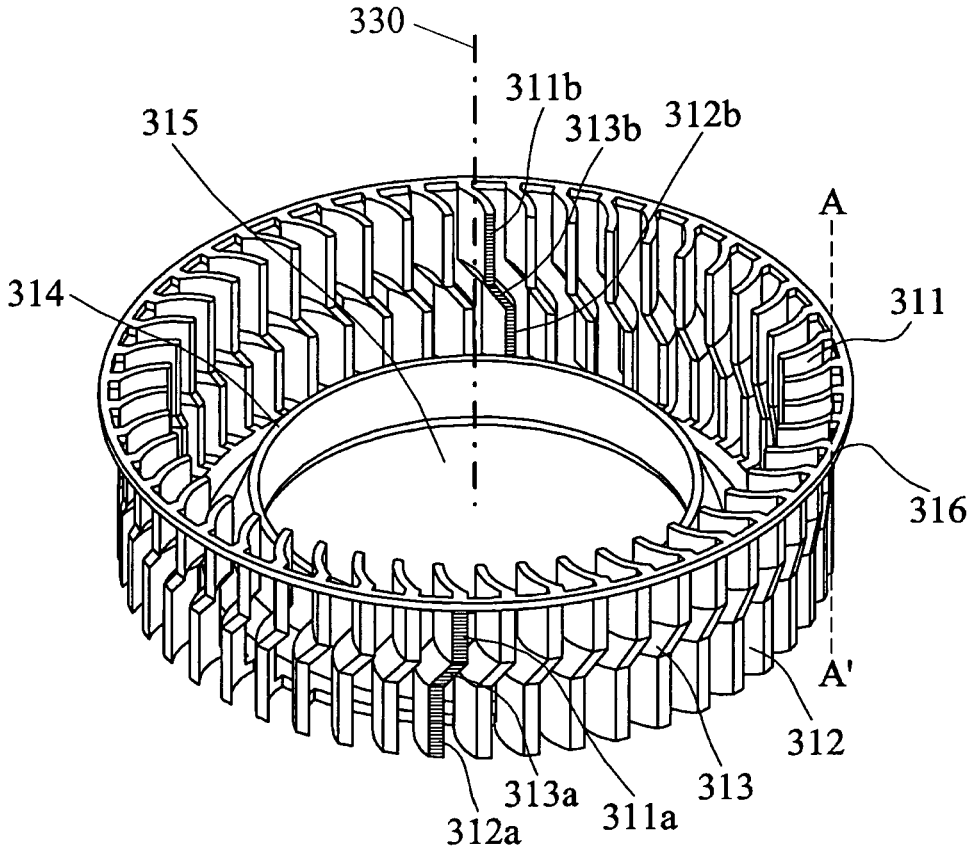
FIG. 4A is a pictorial view showing the blade structure according to one preferred embodiment of the present invention.
Figure 4B:
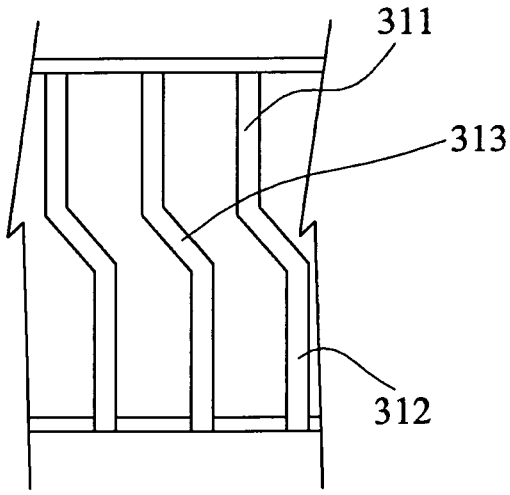
FIG. 4B is a partially cross-sectional view showing the blade structure of FIG. 4A.

Referring to FIG. 3, which is a pictorial view of a blower 3 of the present invention, the blower 3 includes an outer casing 32 and a blade structure 31 provided within the outer casing. The outer casing may be composed of a base seat and an upper cover. In addition, the blade structure 31 includes a first vane group 311 composed of a plurality of vanes, a second vane group 312 composed of a plurality of vanes, and a plurality of inclined portions 313. As shown in FIG. 4A, the inclined portions 313 are connected between the vanes of the first vane group and the vanes of the second vane group. Each vane of the first vane group has an outer edge 311*a* and an inner edge 311*b*. Each vane of the second vane group has an outer edge 312*a* and an inner edge 312*b*. Each inclined portion has an outer edge 313*a* and an inner edge 313*b*. According to the invention, the outer edges 311*a*, 312*a* and 313*a* are in the same plane parallel to an axis 330 of the blower. More specifically, when the blade structure 31 is viewed from one side, it would be more clearly seen that the outer edges 311*a*, 312*a* and 313*a* are arranged in a line such as the dashed line A–A', which is included in a vertical plane with respect to the rotation of the rotor. As shown in FIG. 4B, the outer edge of each inclined portion 313, the outer edge of each vane of the first vane group, and the outer edge of each vane of the second vane group are in the same plane.

In this embodiment, the vanes of the first vane group 311 and the second vane group 312 are arranged in a staggered or alternate manner, as shown in FIG. 4B. Alternatively, the vanes may also be arranged in multiple levels so as to increase the wind pressure of their guided air stream. Consequently, the number of vanes can be greatly increased without changing the size of the blade so as to improve the wind pressure characteristic effectively. The vanes of the first vane group 311 and the second vane group 312 may be of a structural type of a curved surface, an inclined surface, an arched surface, or a flat surface. The vanes of the first vane group 311 and the second vane group 312 may be made of plastic, metal, or other materials with special applications.

The blade structure further includes a base 314 for the vanes of the first vane group 311 and second vane group 312 to be mounted around. The base 314 is formed with a central opening 315 within which a motor for rotating the blade structure is mounted. The vanes of the first vane group 311 and second vane group 312 partially protrude from the bottom of the base. In addition, the blade structure further includes a hoop 316 arranged on the top edges of the vanes of the first vane group so as to reinforce the blade structure 31. The base, the first vane group 311, the second vane group 312, and the inclined portions 313 may be integrally formed.

Figure 5:
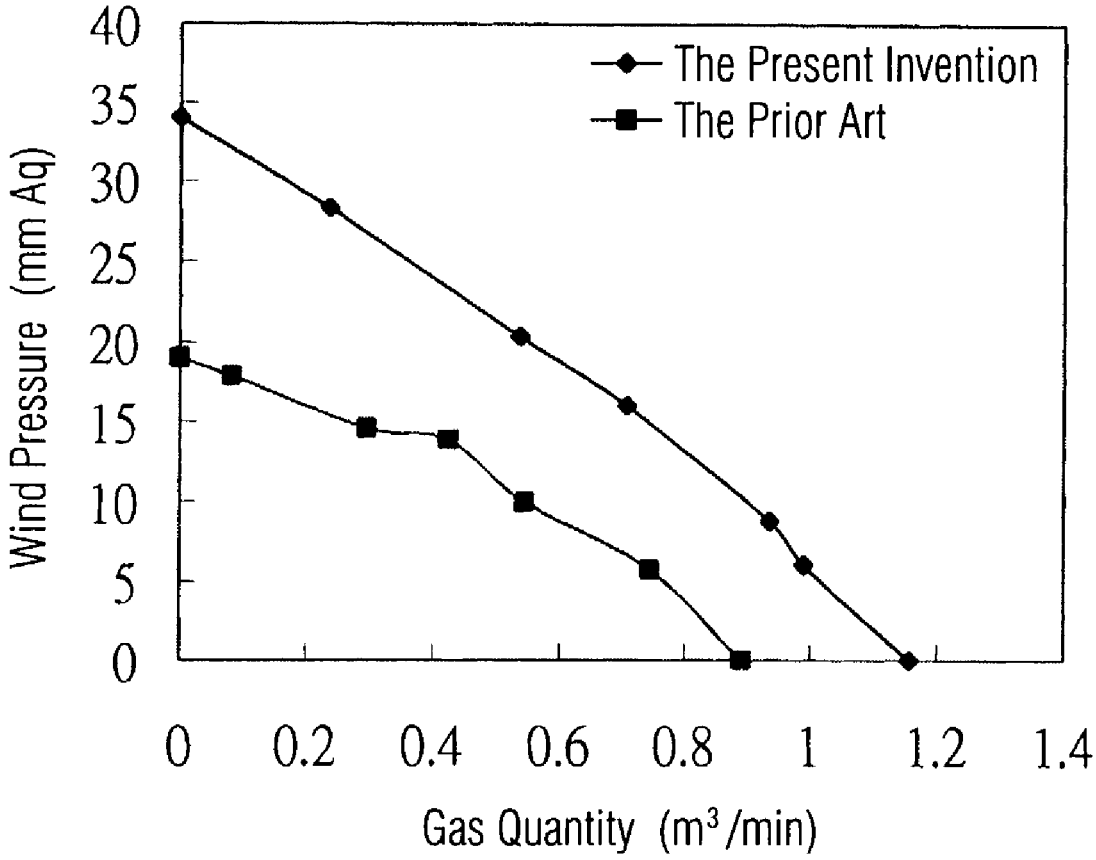
FIG. 5 is a comparative chart regarding the wind pressure characteristic between the second type of the conventional blower and the blower of the present invention.

Please refer to FIG. 5, which shows the comparative result regarding the characteristic of wind pressure between the blower 3 of the present invention and the second type of the conventional blower. As shown in FIG. 5, the design of the blade structure 31 of the present invention, in which the inclined portions are used instead of the annular plate to increase the working area, may significantly increase the wind pressure and the gas quantity, and decrease the noise.

Figure 6:
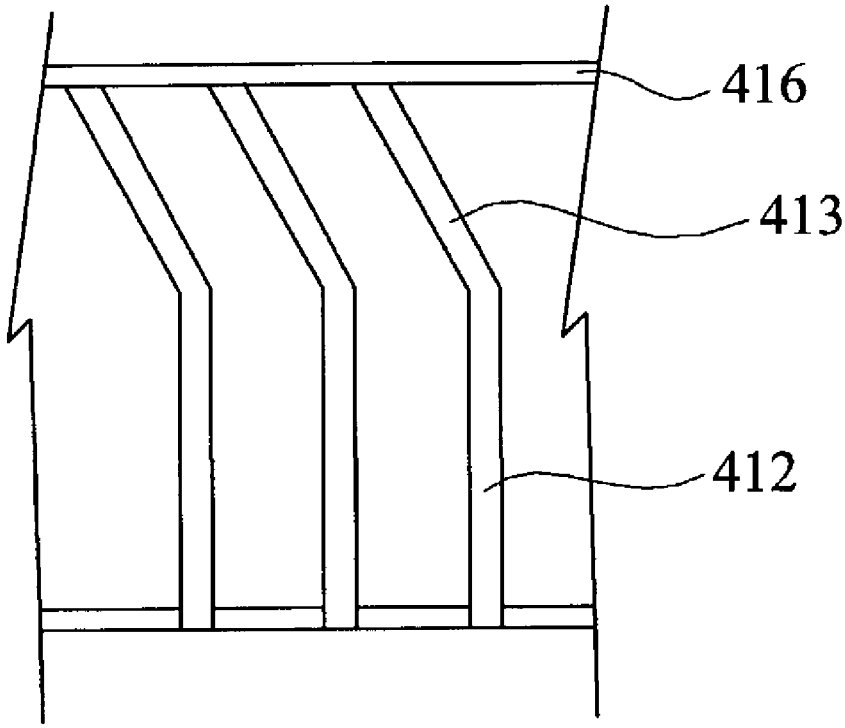
FIG. 6 is a partially cross-sectional view showing the blade structure according to another embodiment of the present invention.

In addition to the above-mentioned embodiment, the blade structure of this invention may also be configured to be the structure as shown in FIG. 6. The difference between this and the above-mentioned embodiments resides in that the blade structure as shown in FIG. 6 only includes one vane group 412 and each of the inclined portions 413 is connected to each vane of the vane group, respectively. A hoop 416 is arranged on the top edges of the inclined portions 413. The characteristics of the wind pressure and gas quantity are also similar to those of the above-mentioned embodiment.

To sum up, the blade structure of this invention may be applied to the single side entry blower or the double side entry blower. The present invention improves the blade structure with respect to the advantages and disadvantages of the prior art by forming the inclined portions for connecting the upper and lower vanes. Therefore, the fan performance can be improved while the noise can also be reduced.

While the present invention has been described by way of examples and in terms of preferred embodiments, it is to be understood that the present invention is not limited to the disclosed embodiments. To the contrary, it is intended to cover various modifications. Therefore, the scope of the appended claims should be accorded the broadest interpretation so as to encompass all such modifications.

What is claimed is:

1. A blade structure, comprising:

a vane group constituted by a plurality of vanes; and a plurality of inclined portions, each of which is connected to each of the plurality of vanes of the vane group, respectively;

wherein the outer edge of each vane of the vane group and the outer edge of each inclined portion are position in the same vertical plane with respect to the rotation of the blade structure.

2. The blade structure according to claim 1, further comprising:

a base around which the plurality of vanes of the vane group are mounted.

3. The blade structure according to claim 2, wherein the base, the vane group, and the plurality of inclined portions are integrally formed.

4. The blade structure according to claim 2, wherein the base is formed with a central opening for a motor driving the blade structure to be mounted therein.

5. The blade structure according to claim 2, wherein the plurality of vanes of the vane group partially protrudes from a bottom of the base.

6. The blade structure according to claim 1, further comprising:

a hoop mounted around a top edge of each of the inclined portions.

7. The blade structure according to claim 1, wherein the vane group and the plurality of inclined portions are alternately arranged in multiple levels to increase the wind pressure of the guided air stream.

8. The blade structure according to claim 1, wherein each of the plurality of vanes of the vane group has a structural type selected from the group consisting of a curved surface, an inclined surface, an arched surface, and a flat surface.

9. A blade structure, comprising:

a first vane group constituted by a plurality of vanes;

a second vane group constituted by a plurality of vanes; and a plurality of inclined portions connected between the vanes of the first vane group and the vanes of the second vane group;

wherein the outer edge of each vane of the first vane group, the outer edge of each vane of the second vane group, and the outer edge of the inclined portion are positioned in the same vertical plane with respect to the rotation of the blade structure.

10. The blade structure according to claim 9, wherein the first vane group, the second vane group, and the plurality of inclined portions are integrally formed.

11. The blade structure according to claim 9, further comprising:

a base around which the plurality of vanes of the first vane group and the plurality of vanes of the second vane group are mounted.

12. The blade structure according to claim 11, wherein the base, the first vane group, the second vane group, and the plurality of inclined portions are integrally formed.

13. The blade structure according to claim 11, wherein the base is formed with a central opening for a motor driving the blade structure to be mounted therein.

14. The blade structure according to claim 11, wherein the plurality of vanes of the first vane group and the plurality of vanes of the second vane group partially protrude from a bottom of the base.

15. The blade structure according to claim 9, further comprising a hoop mounted around a top edge of each of the plurality of vanes of the first vane group.

16. The blade structure according to claim 9, wherein the plurality of vanes of the first vane group and the plurality of vanes of the second vane group are alternately arranged in multiple levels to increase the wind pressure of the guided air stream.

17. The blade structure according to claim 9, wherein the plurality of vanes of the first vane group and the plurality of vanes of the second vane group are arranged alternately.

18. The blade structure according to claim 9, wherein each of the plurality of vanes of the first and second vane groups has a structural type selected from the group consisting of a curved surface, an inclined surface, an arched surface, and a flat surface.

19. A blower, comprising:

an outer casing; and a blade structure mounted within the outer casing, the blade structure comprising:

a first vane group constituted by a plurality of vanes;

a second vane group constituted by a plurality of vanes; and a plurality of inclined portions connected between the vanes of the first vane group and the vanes of the second vane group.

wherein the outer edge of each vane of the first vane group, the outer edge of each vane of the second vane group, and the outer edge of each inclined portion are position in the same plane parallel to an axis of the blower.

20. The blower according to claim 19, wherein the first vane group, the second vane group, and the plurality of inclined portions are integrally formed.

21. The blower according to claim 19, wherein the blade structure further comprises a base around which the plurality of vanes of the first vane group and the plurality of vanes of the second vane group are mounted.

22. The blower according to claim 21, wherein the base is formed with a central opening for a motor driving the blade structure to be mounted therein.

23. The blower according to claim 21, wherein the plurality of vanes of the first vane group and the plurality of vanes of the second vane group partially protrude from a bottom of the base.

24. The blower according to claim 19, wherein the blade structure further comprises a hoop mounted around a top edge of each of the plurality of vanes of the first vane group.

25. The blower according to claim 19, wherein the plurality of vanes of the first vane group and the plurality of vanes of the second vane group are alternately arranged in multiple levels to increase the wind pressure of the guided air stream.

26. The blower according to claim 19, wherein the plurality of vanes of the first vane group and the plurality of vanes of the second vane group are arranged alternately.

27. The blower according to claim 19, wherein each of the plurality of vanes of the first and second vane groups has a structural type selected from the group consisting of a curved surface, an inclined surface, an arched surface, and a flat surface.

28. The blower according to claim 19, wherein the blower is a single side entry blower.

29. The blower according to claim 19, wherein the blower is a double side entry blower.

30. A blower, comprising:

an outer casing; and a blade structure mounted within the outer casing, the blade structure comprising:

a vane group constituted by a plurality of vanes; and a plurality of inclined portions, each of which is connected to each of the plurality of vanes of the vane group, respectively.

wherein the outer edge of each vane of the vane group and the outer edge of each inclined portion are position in the same plane parallel to an axis of the blower.

* * * * *